United States Patent [19]

Yoshida

[11] 4,308,738

[45] Jan. 5, 1982

[54] ROTARY SNAPPING DEVICE

[75] Inventor: Riichiro Yoshida, Tokyo, Japan

[73] Assignee: Copal Company Limited, Tokyo, Japan

[21] Appl. No.: 85,318

[22] Filed: Oct. 16, 1979

[30] Foreign Application Priority Data

| | | | |
|---|---|---|---|
| Oct. 20, 1978 | [JP] | Japan | 53-129226 |
| Nov. 20, 1978 | [JP] | Japan | 53-143105 |
| Dec. 18, 1978 | [JP] | Japan | 53-157894 |
| Feb. 13, 1979 | [JP] | Japan | 54-17044[U] |

[51] Int. Cl.[3] ..... B21D 15/12

[52] U.S. Cl. ..... 72/112; 72/406; 74/22 R; 408/135

[58] Field of Search ..... 72/67, 112, 115, 406; 74/22 R; 408/129, 132, 135; 29/243.53

[56] References Cited

U.S. PATENT DOCUMENTS

| | | | |
|---|---|---|---|
| 2,545,008 | 3/1951 | Senglet | 408/135 |
| 2,634,614 | 4/1953 | Nyquist | 74/22 |
| 2,882,761 | 4/1959 | Knosp et al. | 408/135 |
| 2,902,891 | 9/1959 | Wollenhaupt | 408/135 |
| 3,762,199 | 10/1973 | Yoshikawa | 72/67 |

*Primary Examiner*—Lowell A. Larson

*Attorney, Agent, or Firm*—Cushman, Darby & Cushman

[57] ABSTRACT

A rotary snapping device arranged so that a vertical motion and snapping rotary motion of a snap can be controlled by a single driving motor to simplify the entire structure and to give an excellent performance and function. This snapping device is provided with a manual operating means which can have the above mentioned vertical motion and rotary motion of the snap performed by hand, a manual adjusting means which can optimumly set the working position of the snap and an indicating means which can indicate the moving position in the vertical direction of the snap.

5 Claims, 8 Drawing Figures

ROTARY SNAPPING DEVICE

BACKGROUND OF THE INVENTION (a) Field of the Invention

This invention relates to a rotary snapping device wherein a snap supported rotatably on a spindle as inclined so as to make an angle with the center axis of the spindle is rotated around the above mentioned center axis while holding the angle of inclination so as to be able to apply a snapping work to a rivet or the like.

(b) Description of the Prior Art

According to this kind of snapping device, the snapping work is made by rotating the spindle while pressing the tip of the snap against such part to be worked as a rivet. As the snap is fitted to the spindle through bearings so that the tip of the snap may be positioned at the intersection of the center axis of the spindle with the center axis of the inclined snap, when the spindle is rotated while the snap tip is pressed against the part to be worked, the tip will rotate while rolling on the part to be worked. By the rotary and rolling motions of this snap tip, the part to be worked will be rolled and thereby the snapping work will be made.

Therefore, this snapping method has such many advantages that such noise as in an impact snapping method is not caused. However, in the conventional device, as the snap rotates while rolling, a slip motion is generated between the snap and the part to be worked. There has been a defect that, as this slip motion acts to tear the part to be worked, a fine finished surface can not be obtained. Further, in the conventionaldevice, an oil pressure or air pressure has been utilized to move the spindle in the vertical direction and an electric motor has been utilized to rotate the spindle. The utilization of the oil pressure or air pressure has an advantage that, as the lowermost position of the spindle can be accurately regulated with a stopper, it is very easy to determine the lowermost position of the spindle and to set the finished dimensions of the worked part. However, there has been a defect that, as a fluid compression controlling means to obtain a proper oil pressure or air pressure is required and the leakage of the fluid must be well prevented, the device itself is costly. Particularly, in the case of utilizing the air pressure, there have been disadvantages that not only the detrimental substances contained in the exhaust pollute air and deteriorate the working environment but also the power loss is large. Therefore, there is already suggested a system wherein the spindle is moved in the axial direction while being rotated by an electric motor. However, in such a system, inasmuch as a power transmitting mechanism is formed by a pin-slot connection, there has been a defect that the working to form a slot is difficult and the entire construction becomes complicated.

SUMMARY OF THE INVENTION

A primary object of the present invention is to provide a rotary snapping device wherein a vertical motion and rotary motion of a spindle can be made by a single electric motor to simplify the entire structure and to make the operation and maintenance very easy.

Another object of the present invention is to provide a rotary snapping device wherein the predetermined posture of the snap is held by one spring so as to be able to easily obtain a very fine finished surface.

A further object of the present invention is to provide a rotary snapping device wherein the lowermost position of the spindle can be regulated very accurately so as to be able to obtain a high finish precision of the worked article.

A further object of the present invention is to provide a rotary snapping device wherein the lowermost position of the spindle can be adjusted always as required and the adjustment can be indicated on a scale.

Another object of the present invention is to provide a rotary snapping device arranged so that the manual operation may be possible.

Another object of the present invention is to provide a rotary snapping device wherein the spindle moves to fall at a comparatively low speed but to rise at a comparatively high speed and the moving direction of the spindle is indicated.

These and other objects of the present invention will become more apparent during the course of the following detailed description and appended claims.

DESCRIPTION OF THE PREFERRED EMBODIMENTS

Figure 1:
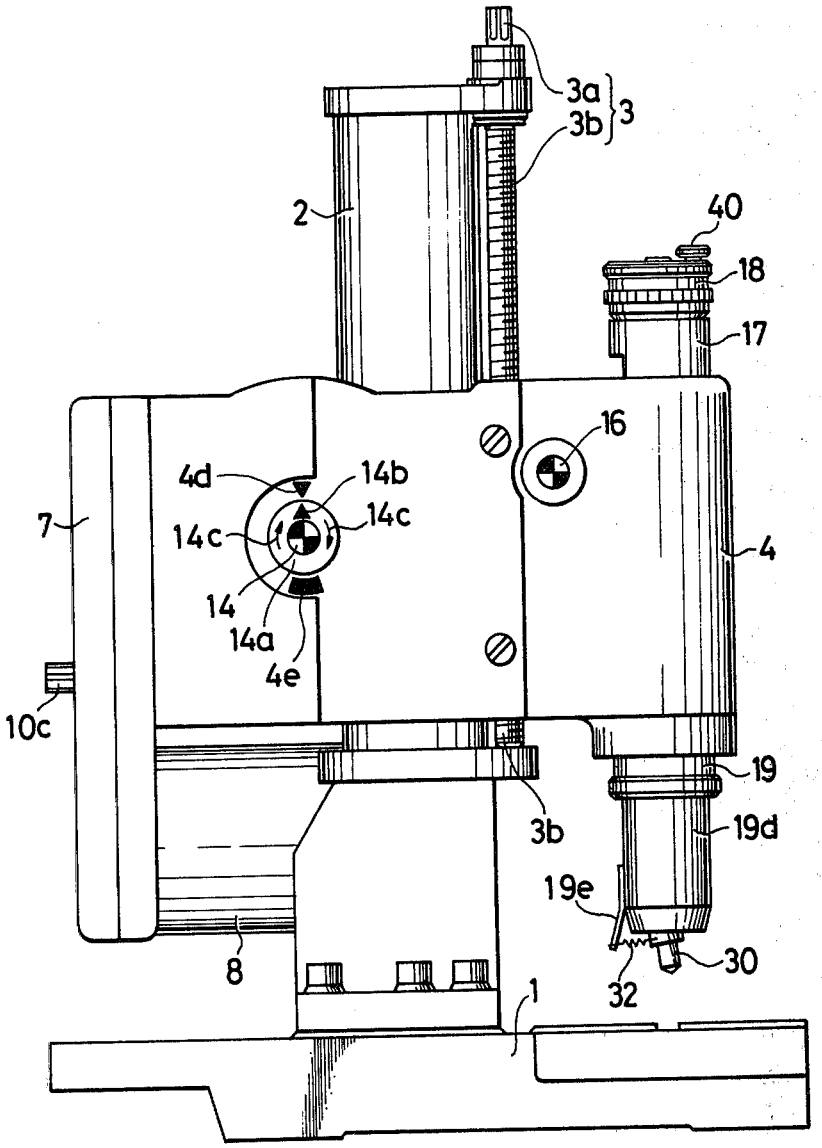
FIG. 1 is an elevational view showing the appearance of a rotary snapping device according to the present invention.

In FIGS. 1 to 7, reference numeral 1 indicates a base having handles 1*a*, 1*b* and 1*c* to be used in carrying the device and the handle 1*c* is located on the back side of the drawing and is arranged in a position symmetrical to that of the handle 1*b*. 2 indicates a hollow cylindrical column fixed to the base 1. 3 indicates a screw rod which is supported by the column 2 so as to be rotatable at both upper and lower ends, is formed to be square in the upper end portion 3*a* so as to be able to fit a handle not illustrated and has a screw 3*b* formed over the entire intermediate portion. 4 indicates a sliding head which has a slit 4*a*, a hole 4*b* through which the column 2 is inserted, a screw portion 4*c* screwed with the screw portion 3*b* of the screw rod 3, an upper index 4*d* for indicating the uppermost position of a later described spindle 20 in connection with a later described index 14*b* and a lower index 4*e* for indicating the lowermost position of the spindle 20, is movable in the vertical direction with the column 2 as a guide by the rotation of the screw rod 3 and can be fixed to the column 2 by fastening a bolt 5. 6 and 7 indicate cover plates fitted to the sliding head 4. 8 indicates a driving motor fitted to the sliding head and having a pulley 9 secured to a rotary shaft 8*a*. This motor 8 is so made by a known brake circuit not illustrated as to be able to be electrically quickly stopped when it is to be stopped. 10 indicates a driving shaft which is rotatably mounted on the sliding head 4 and has a worm 10*a*, a helical gear 10*b* fitted through a one-way clutch not illustrated and an end portion 10*c* projected out of the cover plate 7 and formed to be square so as to be able to fit a handle not illustrated. 11 indicates a pulley fitted to the driving shaft 10. 12 indicates a belt hung between the pulleys 9 and 11. The above mentioned helical gear 10*b* is so made as to be rotated integrally with the rotary shaft 10 through the one-way clutch when the driving shaft 10 is rotated by the electric motor 8 but to be rotated only by the inertia rotation of the later described spindle 20 when the motor 8 is quickly stopped by the known brake circuit not illustrated. In such case, the inertia rotation of the spindle 20 will not be transmitted to the driving shaft 10. 13 indicates a driving wheel which is pivoted on the sliding head 4 by a shaft 14 and has a worm wheel 13*a* meshing with the worm 10*a* and a high cam 13*b* and low cam 13*c* formed integrally on the side surface of said worm wheel 13*a*. A disk 14*a* which has the index 14*b* able to cooperate with the upper index 4*d* and lower index 4*e* and an arrow 14*c* for indicating whether the later described spindle 20 is rising or falling is secured to the shaft 14. 15 indicates a driving lever which is pivoted on the sliding head 4 by a shaft 16 and has a slot 15*a* pin-slot connected with the pin 13 *d* and a sector gear 15*b*. 17 indicates a movable cylinder which has a rack gear 17*a* meshing with the sector gear 15*b* and an index 17*b* on the outer periphery and an inward projected pin 17*c*. This movable cylinder 17 is so held as to be unable to rotate by the meshing of the rack gear 17*a* with the sector gear 15*b*. 18 indicates a finely adjusting grip which is rotatably fitted to the upper end portion of the movable cylinder 17 and has a scale 18*a* able to cooperate with the index 17*b* on the outer peripheral portion and a screw shaft 18*b* in the center portion. 19 indicates a spindle holding cylinder which has a screw portion 19*a* meshing with the screw shaft 18*b*, a slot 19*b* slidably fitted to the pin 17*c*, an incision 19*c*, a protective cylinder 19*d* and a spring hanger 19*e*. 20 indicates the spindle which has a helical gear portion 20*a* meshing with the helical gear 10*b* and a screw portion 20*b* having a later described head 24 screwed to it and is rotatably held within the spindle holding cylinder 19 by bearings 21, 22 and 23. 24 indicates the head which has a screw portion 24*a* screwed to the screw portion 20*a* of the spindle 20 and forms an inner cylinder 24*b* having as a center axis a line b intersecting with the center axis a of the spindle 20 at a point O with an inclination of an inclination angle $\theta$. 25 indicates a snap holder supported rotatably within the inner cylinder 24*b* through bearings 26, 27 and 28. 29 indicates a pin for preventing the bearing 28 from being pulled out. 30 indicates a snap which has a working portion 30*a* and can be held in the snap holder 25 by the frictional force of an O-ring 31. This snap 30 is so held in the snap holer 25 that its center tip may coincide with the point O at which the lines a and b intersect with each other. 32 indicates a holding spring which is stretched between the spring hanger 19*e* and snap holder 25 and serves to have the posture of the snap holder 25 in the rotating direction with the line a as a center axis with respect to the spindle holding cylinder 19 kept constant. 33, 34 and 35 indicate switches which are switched on and off as operatively connected with the high cam 13*b* and low cam 13*c* of the driving wheel 13. 36 indicates a switch operated by such operating member as a foot pedal not illustrated. 37 indicates a self-held type relay consisting of an electromagnetic coil 37*a*, a movable contact piece 37*b*, a normally closed contact 37*c* and a normally opened 37*d*. 38 indicates a current source. 39 indicates a main switch. The above mentioned switches 33, 34 and 35 may be replaced with such other switching means as relays.

The operation of this device is as follows.

Figure 2:
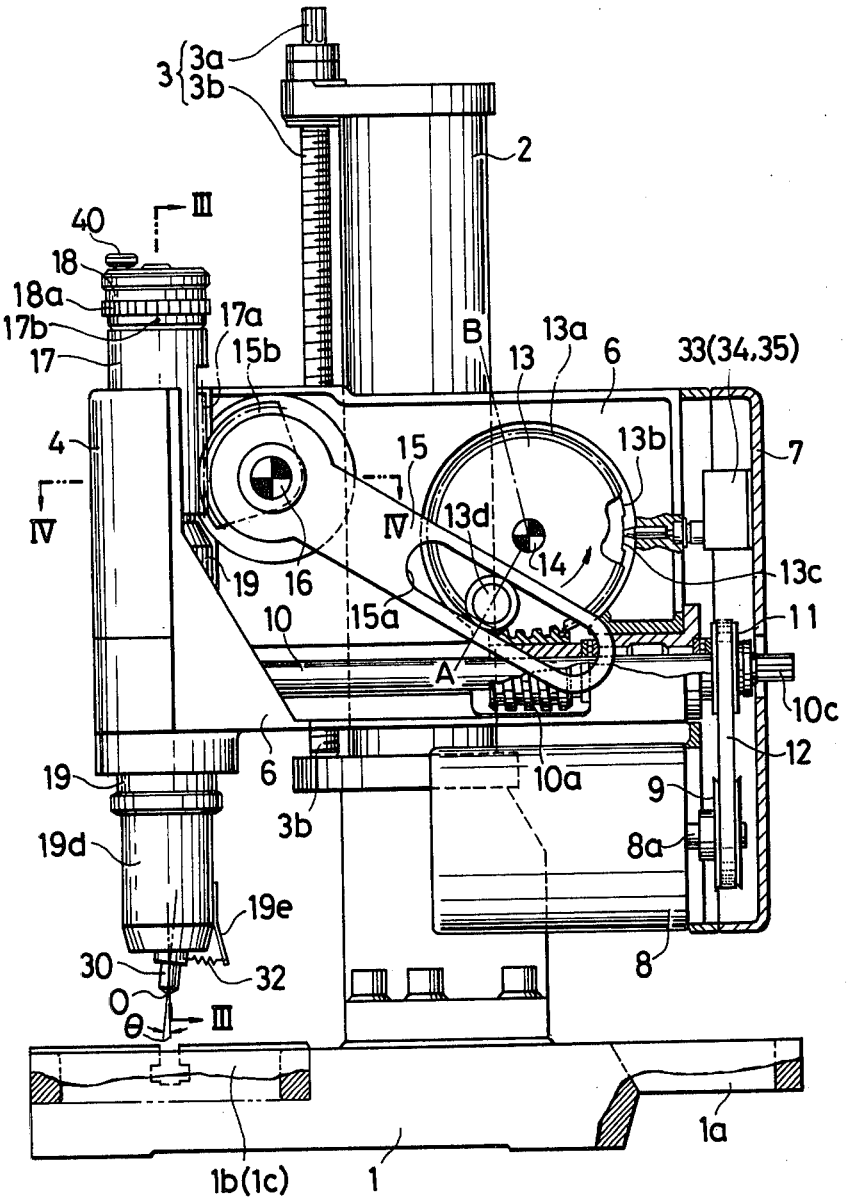
FIG. 2 is a back view of FIG. 1 shown as partly sectioned.
Figure 3:
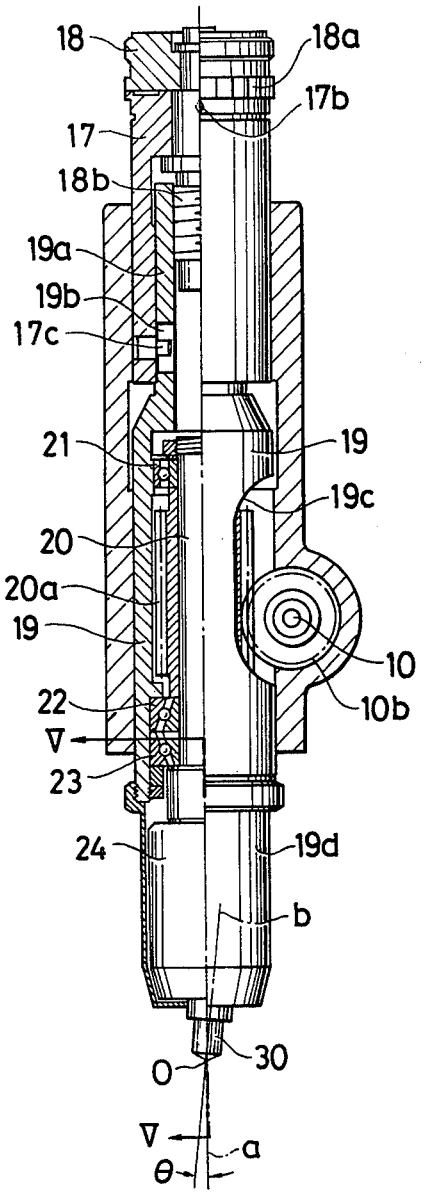
FIG. 3 is a sectional view along the line III—III in FIG. 2.
Figure 4:
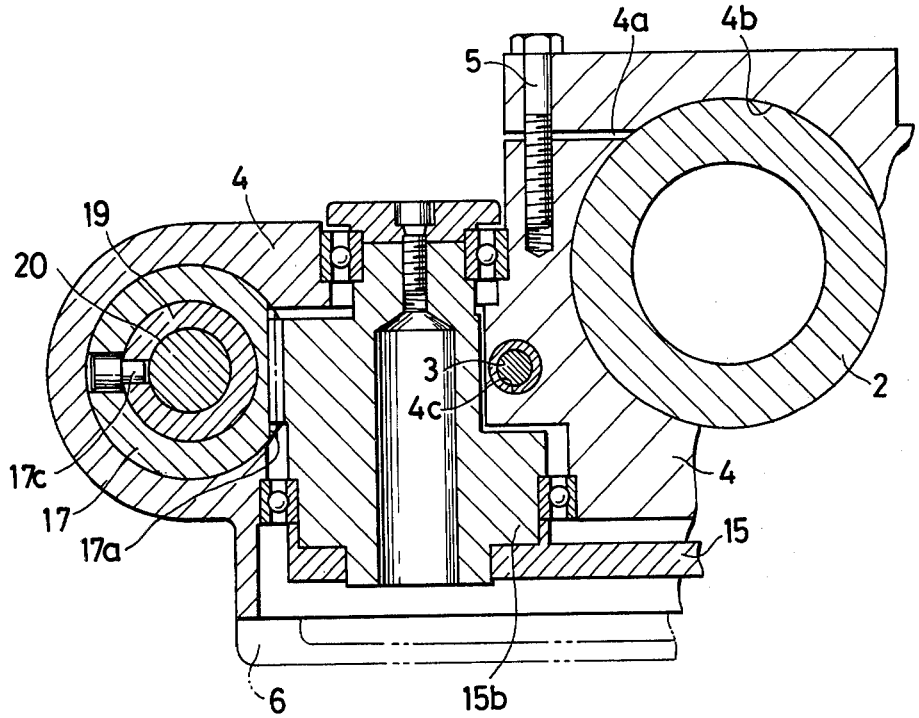
FIG. 4 is a sectional view along the line IV—IV in FIG. 2.
Figure 5:
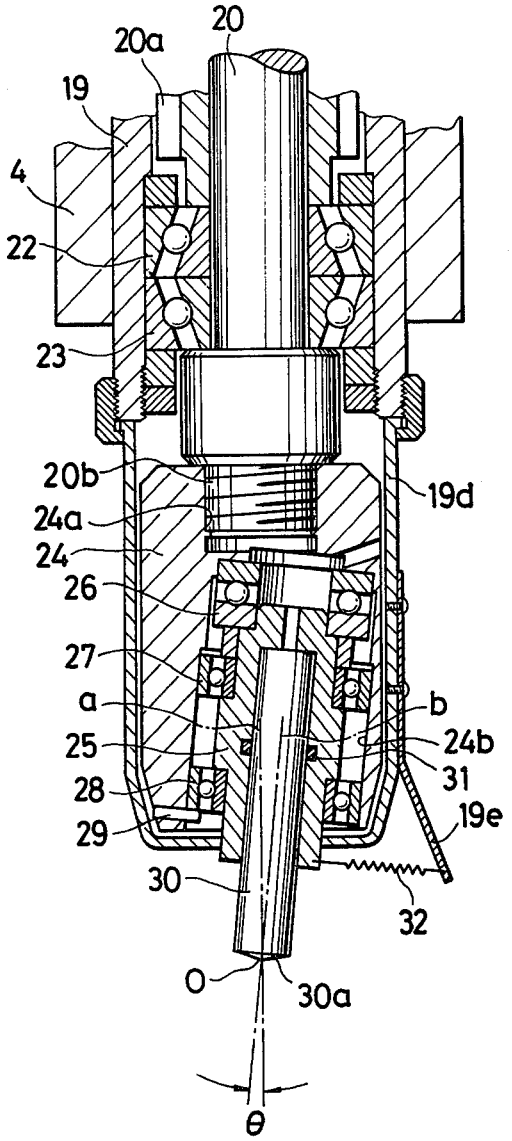
FIG. 5 is a sectional view along the line V—V in FIG. 3.
Figure 6:
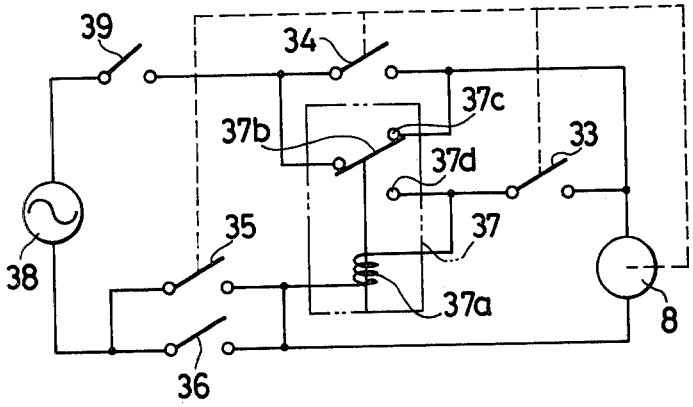
FIG. 6 is a wiring diagram showing an example of operation controlling circuit.

FIGS. 1, 2 and 6 show the device at rest. In FIG. 6, when the main switch 39 is closed first and then the operating switch 36 is closed, in this stage, as the switch 33 is not yet closed, only the electric motor 8 will be connected to the current source 38 and will begin to rotate.

In FIG. 2, when the motor 8 begins to rotate, the driving shaft 10 will be rotated through the belt 12 and the driving wheel 13 will begin to rotate counterclockwise through the worm 10*a* and worm wheel 13*a*. Also, the driving shaft 10 will rotate the spindle 20 through the one-way clutch not illustrated and the helical gears 20*a* and 10*b*. In such case, the rotating direction of the spindle 20 may be either in working.

When the driving wheel 13 thus begins to rotate counterclockwise in FIG. 2, the shaft 14 integral with it will also begin to rotate and, as a result, will rotate clockwise in FIG. 1. Therefore, in FIG. 1, the disk 14*a* will also rotate clockwise as indicated by the arrow 14*c*, the index 14*b* will separate from the upper index 4*d*, will move toward the lower index 4*e* and will indicate that the spindle 20 is now falling. While the spindle 20 has fallen and is working, the index 14*b* will continue to point the lower index 4*e* and will indicate that the spindle 20 is in the lowermost position. When the work ends and the spindle 20 begins to rise, the index 14*b* will correspondingly separate from the lower index 4*e*, will again move toward the upper index 4*d* and will indicate that the spindle 20 is rising.

When the driving wheel 13 is rotated counterclockwise in FIG. 2 as described above, the switch 33 which has been opened by the engagement with the low cam 13*c* will be closed together with the other switches 34 and 35 and the electromagnetic coil 37*a* will be energized. When the electromagnetic coil 37*a* is thus energized, the movable contact piece 37*b* will be switched over to the contact 37*d*. During the switching operation of this movable contact piece 37*b*, the movable contact piece 37*b* will be separated from any contact but, as the switch 34 is closed, the electric motor 8 and electromagnetic coil 37*a* will be kept connected with the current source 38 even in the meanwhile. Further, in this state, even if the foot is separated from such operating member as, for example, a foot pedal not illustrated, as the switch 35 is kept closed by the high cam 13*b*, the connection with the current source 38 will not be interrupted.

At the same time as the driving wheel 13 rotates and the circuit is switched over as mentioned above, the pin 13*d* will begin to move counterclockwise from the position A, therefore the driving lever 15 will be rotated counterclockwise with the shaft 16 as a fulcrum and, as a result, the movable cylinder 17 will be lowered through the sector gear 15*b* and rack gear 17*a*.

In case the movable cylinder 17 lowers, it will lower simultaneously with the spindle holding cylinder 19 and spindle 20 but, in this fall, the spindle 20 will be accelerated in the rotation by the meshing of the helical gears 10*b* and 20*a* with each other. This accelerating degree will be determined by such elements as the spiral angle and pitch of the helical gears 10*b* and 20*a* and the rotating direction of the spindle 20.

When the pin 13*d* has been rotated by at least 180 degrees from the position A to the position B by the counterclockwise rotation of the driving wheel 13, the spindle 20 will reach the lowermost position and then the work will end. Thereafter, the pin 13*d* will move from the position B to the position A to complete one rotation. During this rotation, the rotating speed of the driving wheel 13 will be constant if the inertia is excepted.

In case the spindle 20 is rotated by the electric motor 8 through the driving shaft 10, as the snap holder 25 is pulled by the spring hanger 19*e* integral with the spindle holding cylinder 19 by the holding spring 32, this spindle holding cylinder 19 will not rotate. Therefore, this snap holder 25 will not also rotate, only its inclining direction will continuously move and, as a result, the snap 30 will move on a conical surface. Further, in working, when the spindle 20 lowers, brings the snap 30 near to an article to be worked not illustrated and presses the working portion 30*a* against such article to be worked as a rivet, due to the frictional force acting on the contact part, the snap 30 will not slide but will only roll between the working portion 30*a* and the article to be worked. That is to say, the rotation around the axis b of the snap 30 at the time of working will be determined only by the frictional force between the working portion 30*a* of the snap 30 and the article to be worked.

As can be understood from this explanation, during the snapping work, due to the rolling contact between the article to be worked and the working portion 30*a*, the snap 30 will tend to be rotated in the direction reverse to the spindle 20 but, as the snap 30 has the inclined posture held resiliently by the spring 32 through the snap holder 25, the surface of the article to be worked will not be picked off but will be able to be favorably worked.

When the pin 13*d* has returned to the position A from the position B, the switches 33, 34 and 35 will have their switch operating members engaged with the low cam 13*c* and will opened and the electric motor 8 will be disconnected from the current source 38. In such case, even if the foot pedal is trodden and the operating switch 36 is closed, as the movable contact piece 37*b* is held as connected to the contact 37*d*, simultaneously with the opening of the switches 33 and 34, the electric motor 8 will be disconnected from the current source 38 and will be quickly stopped by the brake circuit not illustrated. Thereafter, if the operating switch 36 is opened, the current passed to the electromagnetic coil 37*a* will stop, the movable contact piece 37*b* will automatically switch over to connect with the contact 37*c* and will return to the illustrated state.

Figure 7:
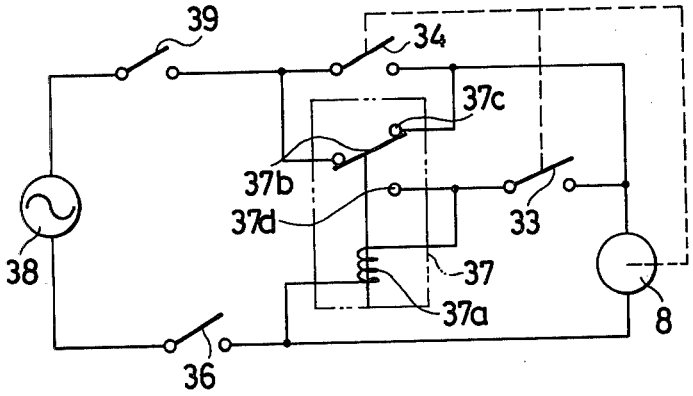
FIG. 7 is a wiring diagram showing an operation controlling circuit somewhat different from that of FIG. 6.

In the above, in consideration of the safety, it is made possible by eliminating the switch 37 as shown in FIG. 7 to disconnect the electric motor 8 from the current source 38 as soon as the operating switch 36 is opened. Thereby, even when the switches 33 and 34 are in contact by the high cam 13*b*, the operating switch 36 will be opened to be able to immediately stop the motor 8 and therefore it will be possible to prevent danger and to stop the work.

The fundamental operation of the present device has been explained in the above. As evident from this explanation, as it is so formed that, during one rotation of the driving wheel 13, about $\frac{2}{3}$ rotation can be utilized for the falling motion of the spindle 20 and the rest about $\frac{1}{3}$ rotation can be utilized for the rising motion of the spindle, as a result, the spindle 20 will be lowered at a comparatively low speed but the rising motion will be made at a comparatively high speed. This means that a favorable result of working the article to be worked can be guaranteed and the operation can be ideally performed.

Now, the case that the present device is manually operated, that is, the case that the driving shaft 10 is rotated by hand shall be explained.

The manual operation of the driving shaft 10 will be required from the viewpoint of the safety in the case of presetting the lowermost position of the snap 30 prior to the working operation or in the case that the spindle stops between the uppermost position and the lowermost position due to a suspension of the current or an accident during the operation.

In order to manually operate the driving shaft 10, first the main switch 39 is opened and then the handle not illustrated is fitted to the end portion 10*c*. When the handle is thus rotated in a predetermined direction, the driving shaft 10 will be rotated the same as in the case by the motor 8 and the spindle 20 will be operated as already explained. It is as described above that the uppermost position or lowermost position of the spindle 20 can be known from the position of the index 14*b*. Therefore, the above mentioned manual operation can be made quickly and accurately.

The lowermost position of the spindle 20 is determined by the dimensions of the article to be worked. The accurate setting of this lowermost position is an element important to attain a favorable snapping work. The operation of adjusting the lowermost position of the spindle 20 shall be explained in the following.

In the state in FIG. 2, in order to set the lowermost position of the spindle, that is, the snap 30, first the bolt 5 is loosened and then the screw rod 3 is rotated to move the sliding head 4 in the vertical direction with respect to the column 2 through the handle not illustrated fitted to the upper end portion 3*a*. The rotation of the screw rod 3 serves to make a rough adjustment to set the lowermost position of the snap 30. Therefore, when the snap 30 has reached the vicinity of a predetermined position due to the rotation of the screw rod 3, the bolt 5 is fastened to fix the sliding head 4 with respect to the column 2, then the driving shaft 10 is rotated by hand by such method as is described above to lower the spindle 20 and to stop it in the lowermost position. In this state, then a set screw 40 is loosened and the finely adjusting grip 18 is rotated to finely move the spindle holding cylinder 19 in the vertical direction through the screw portions 18*b* and 19*a* so as to move the spindle 20 and snap 30 in the vertical direction. When the tip of the snap 30 has thus accurately reached the predetermined position, the set screw 40 is fastened to fix the finely adjusting grip 18 so as not to rotate relatively with the movable cylinder 17. Thus the lowermost position of the snap 30 can be very accurately set. After this setting is completed, the driving shaft 10 is again rotated by hand to return the driving wheel 13 and snap 30 to the positions in FIG. 2. As can be understood from this explanation, by checking the worked article sometimes during the operation, in case it has become necessary to correct the finished dimensions, the set screw 40 is loosened again, the grip 18 is rotated by a required angle with reference to the value of the scale 18*a* opposed to the index 17*b* and thereby a product having desired finished dimentions can be always obtained.

Figure 8:
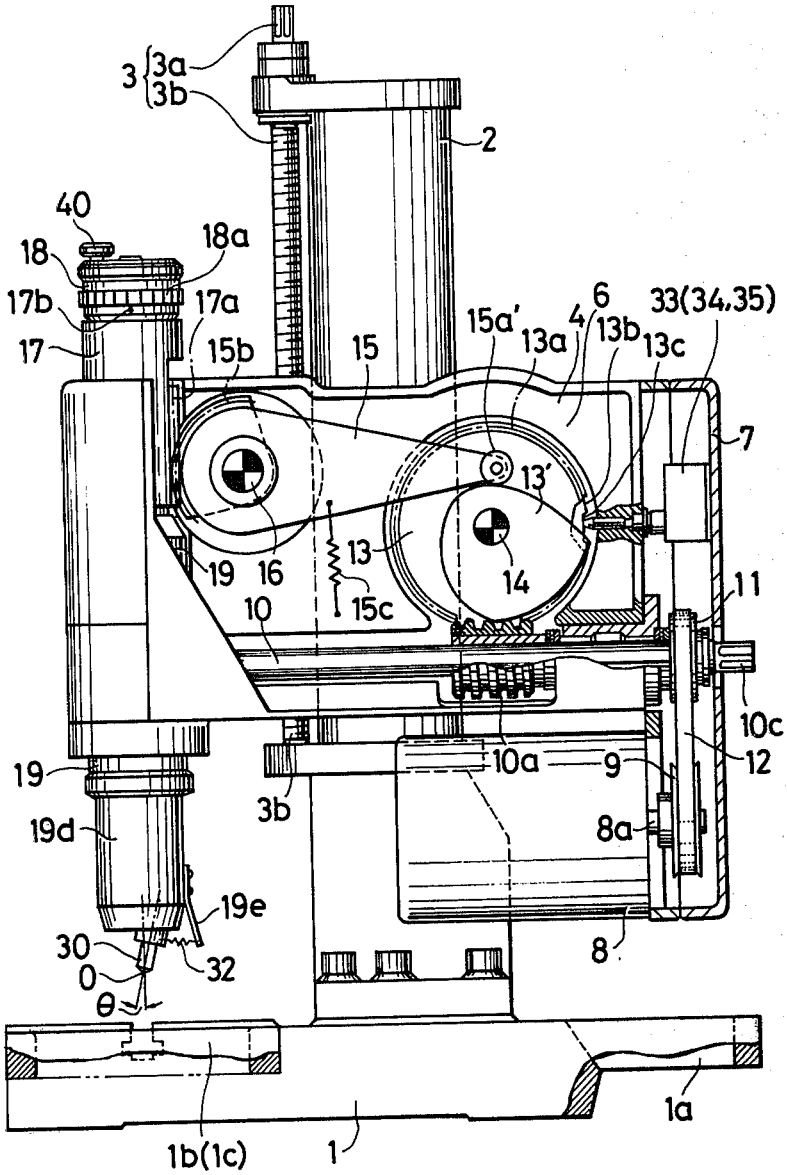
FIG. 8 is the same view as FIG. 2 showing another embodiment of the present invention.

An embodiment somewhat different from that in FIG. 2 is shown in FIG. 8. That is to say, in the embodiment in FIG. 2, the driving lever 15 is rocked by the driving wheel 13 through the pin-slot connection. But, in the embodiment in FIG. 8, the driving lever 15 is rocked by a cam 13' secured on the side surface of the driving wheel 13. A roller 15*a'* which can roll in contact with the cam surface of the cam 13' is rotatably supported at the tip of the driving lever 15 and a spring 15*c* biasing the driving lever 15 clockwise is connected to the driving lever 15. The same reference numerals are attached respectively to the same component parts and portions as are shown in FIG. 2. The formations and operations of the other portions than of the above described formation are the same as are shown in FIG. 2 and shall not be further explained. The contour of the cam 13' is so selected that the greater part of one rotation of the driving wheel 13 may be used for the falling motion of the spindle 20 and the spindle 20 may be raised by the remaining slight part of the rotation.

I claim:

1. A rotary snapping device comprising a sliding head, a column supporting said sliding head movably in the vertical direction, a base supporting said column, a driving shaft rotatably mounted on said sliding head, a driving motor fitted to said sliding head and connected to said driving shaft to rotate said driving shaft, a spindle assembly which includes a rotatable spindle therein and which is mounted at right angles with said driving shaft on said sliding head, said spindle being connected to said driving shaft by meshing a first helical gear provided on said driving shaft with a second helical gear which is formed on the outer peripheral surface of said spindle over the moving range of said spindle, a driving wheel which is rotatably supported on said sliding head and is connected to said driving shaft so as to be rotated by the rotation of said driving shaft, a driving lever which is rotatably supported on said sliding head and is operatively connected in one end portion to said driving wheel and in the other end portion to said spindle to move said spindle in the vertical direction, and a snap rotatably supported in a posture inclined with respect to said spindle at the lower end of said spindle, said spindle being made to make one reciprocation between the uppermost position and the lowermost position through said driving lever while said driving wheel makes one rotation.

2. A rotary snapping device according to claim 1 wherein said driving shaft has an end portion projected out of said sliding head and formed to be square.

3. A rotary snapping device according to claim 1 wherein said spindle assembly further comprises a spindle holding cylinder which rotatably supports said spindle and is supported slidably in the vertical direction on said sliding head; a movable cylinder which is supported slidably in the vertical direction on said sliding head, is slidably fitted to said spindle holding cylinder, is pin-slot connected with said spindle holding cylinder to hold said spindle holding cylinder so as to be movable only in the vertical direction and has an index on the outer peripheral surface; and a finely adjusting grip which is slidably fitted to said movable cylinder, has a scale able to cooperate with said index on the outer peripheral surface and is screwed to said spindle holding cylinder, and said spindle holding cylinder is moved in the vertical direction with respect to said movable cylinder when said finely adjusting grip has been rotated; and a set screw which is screwed to said finely adjusting grip and can connect said finely adjusting grip and movable cylinder with each other.

4. A rotary snapping device according to claim 1 wherein said rotary snapping device further comprises a head screwed to said spindle and supporting rotatably said snap, a holding spring connected between said spindle assembly and snap to resiliently hold the rotation of said snap.

5. A rotary snapping device according to claim 1 wherein said rotary snapping device further comprises a fixed index provided on said sliding head and an indicating means which is provided on the rotary shaft end surface of said driving wheel and can cooperate with said fixed index and the uppermost position and lowermost position of said spindle assembly and the moving direction of said spindle assembly between said two positions are indicated by the cooperation of said fixed index and indicating means.

* * * * *